343-909 SR
5/29/79 OR 4,156,878

United States Patent [19]
Dion

[11] 4,156,878
[45] May 29, 1979

[54] WIDEBAND WAVEGUIDE LENS

[75] Inventor: Andre R. Dion, Concord, Mass.

[73] Assignee: The United States of America as represented by the Secretary of the Air Force, Washington, D.C.

[21] Appl. No.: 872,203

[22] Filed: Jan. 25, 1978

[51] Int. Cl.[2] ..... H01Q 15/04
[52] U.S. Cl. ..... 343/909
[58] Field of Search ..... 343/753, 754, 755, 909, 343/910, 854

[56] References Cited

U.S. PATENT DOCUMENTS

| | | | |
|---|---|---|---|
| 2,607,009 | 8/1952 | Affel | 343/753 |
| 3,049,708 | 8/1962 | Berkowitz | 343/753 |
| 3,833,909 | 9/1974 | Schaufelberger | 343/754 |

FOREIGN PATENT DOCUMENTS

| | | | |
|---|---|---|---|
| 838333 | 5/1952 | Fed. Rep. of Germany | 343/909 |

*Primary Examiner*—Eli Lieberman
*Attorney, Agent, or Firm*—Joseph E. Rusz; Willard R. Matthews, Jr.

[57] ABSTRACT

A waveguide lens having improved efficiency and bandwidth characteristics is realized by appropriately combining the waveguide element array configuration of a conventional zoned waveguide lens with the phase shifting means of a constant thickness variable phase shift type waveguide lens. The length of each waveguide element and the phase shift required of its phase shifting means are functions of the waveguide elements radial distance from the lens axis. Design equations for determining waveguide element length and phase shift values are developed using both single and double frequency design procedures.

2 Claims, 10 Drawing Figures

FIG. 4
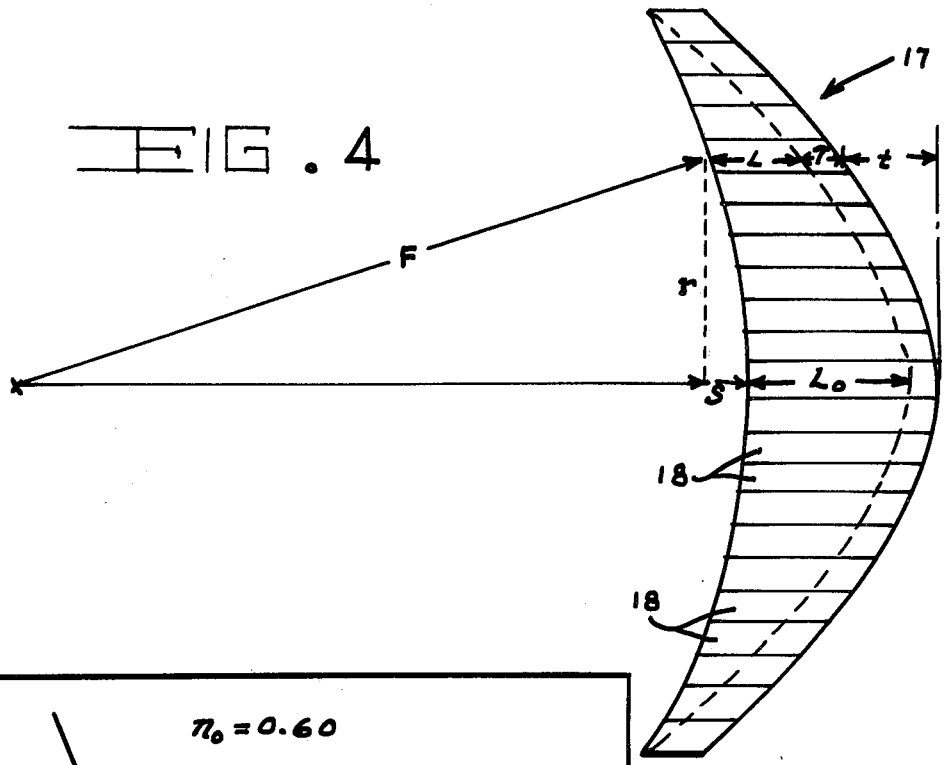
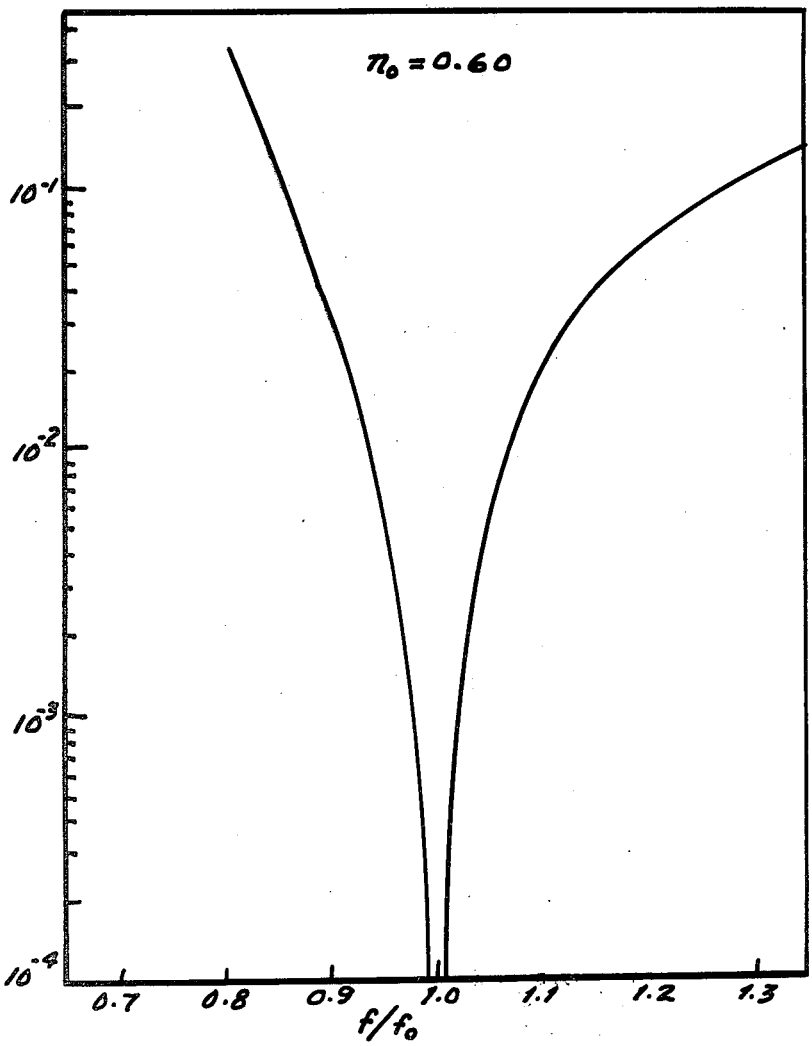
FIG. 5

FIG. 6
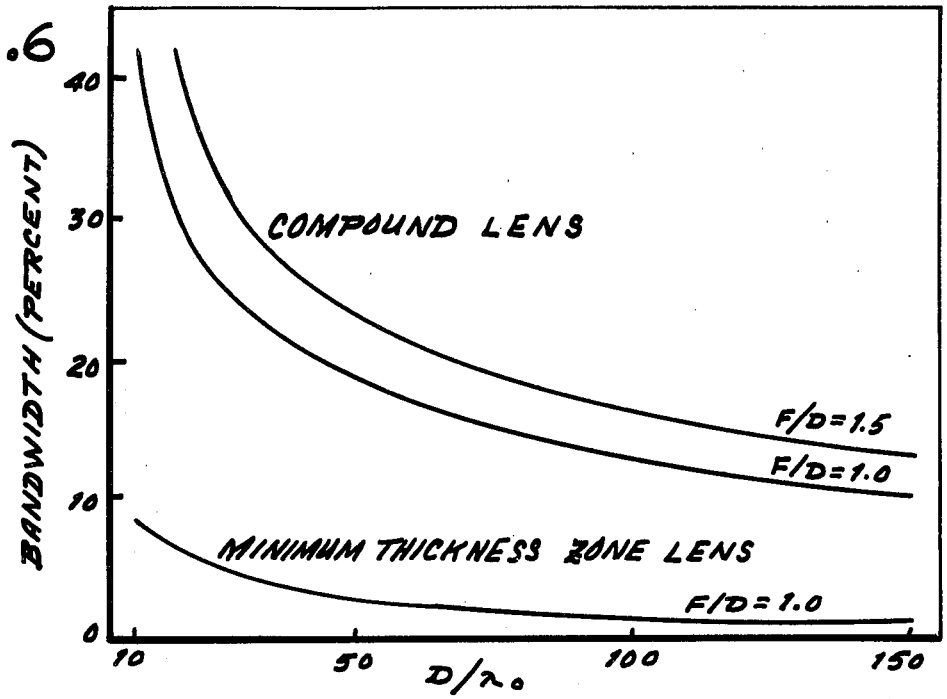
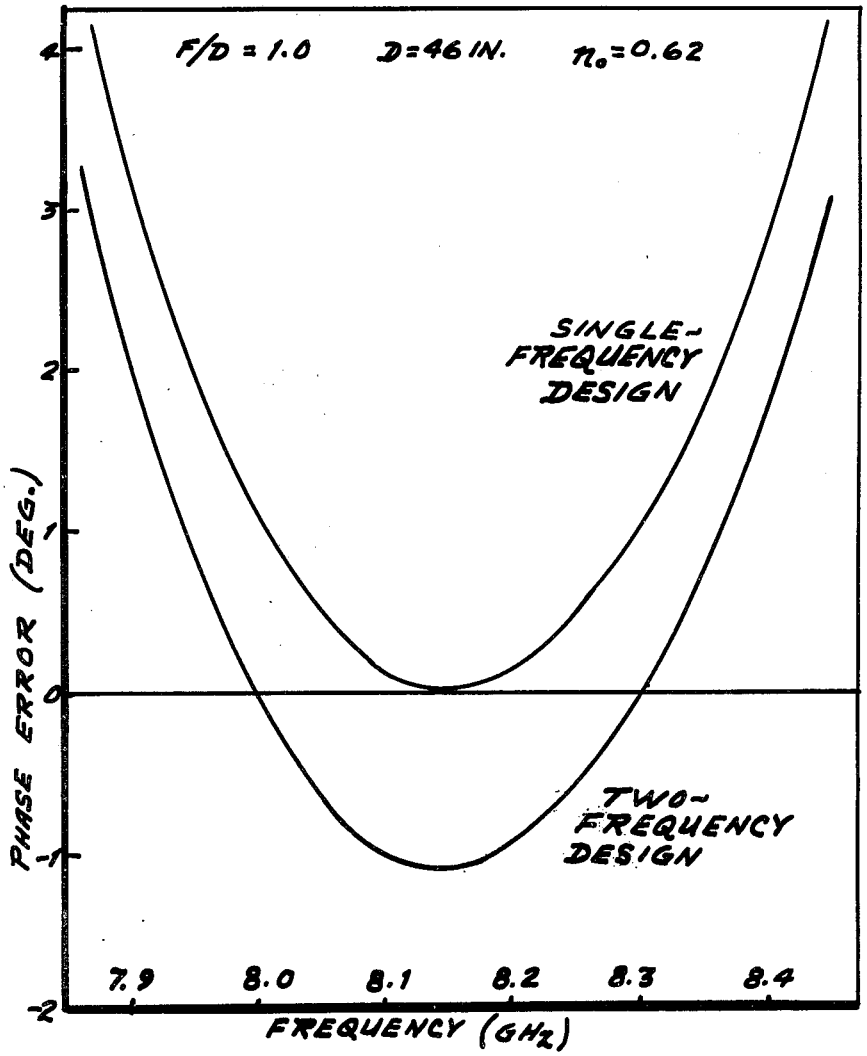
FIG. 7

WIDEBAND WAVEGUIDE LENS

BACKGROUND OF THE INVENTION

This invention relates to waveguide lenses and in particular to a highly efficient broadband waveguide lens for use in very high frequency broadband multiple beam antennas.

Waveguide lenses are used to focus electromagnetic energy into a feed, or into a cluster of feeds, in a manner similar to parabolic mirrors. This type of lens comprises an assemblage of short waveguide elements posistioned side by side, with the combined inner and outer surfaces shaped to a lens contour. Waveguide lenses are in general very lightweight devices. This property makes them preferred over dielectric lenses at radio frequencies. Several varieties of waveguide lenses exist. One variety, the zoned waveguide lens, is made of hollow waveguides and its outer surface is stepped in concentric rings of appropriate radii. Another variety, the constant thickness waveguide lens, employs a phase shifter in each waveguide element to produce the phase correction required for focusing.

The principal advantage of a waveguide lens over a parabolic reflector is the absence of a feed in the path of a wave incident on the lens. This advantage makes the waveguide lens a preferred component in multiple beam antenna and other systems in which relatively large feeds are required. Another advantage of a waveguide lens over a parabolic reflector is its better beam scan characteristics.

The chief disadvantage of waveguide lenses of conventional design is the narrow bandwidth over which the plane wave produced by a lens remains flat within given tolerances. For instance, for a tolerance of $\pm 1/16$ of a wavelength the bandwidth ranges from about 4% for a lens of diameter equal to 20 wavelengths to about 2% for a lens of diameter equal to 100 wavelengths.

In addition to bandwidth considerations the design of waveguide lenses comprehends both lens thickness and phase error. Waveguide lenses are commonly zoned for either minimum phase error or minimum thickness. It is another disadvantage that zoned waveguide lenses exhibit a reduction in efficiency due to the existance of shadowing effects.

Accordingly these currently exists the need for a waveguide lens that has a wider bandwidth and that is more efficient than state-of-the-art zoned waveguide lenses. The present invention is directed toward satisfying that need.

SUMMARY OF THE INVENTION

The waveguide lens of the invention comprises a two dimensional array of proximate, parallel waveguide elements. A central waveguide element of the array has its longitudenal axis coincident with the lens electromagnetic wave transmission axis. Each element is provided with a frequency independent phase shift means. The length of each waveguide element is a function of its radial distance from the lens axis. The phase shift in each waveguide element is also a function of the elements radial distance from the lens axis. Waveguide element length and phase shift values are defined by equations developed for both single and double frequency lens design. In general the overall structure of the device is configured to form a concave-convex lens that is analogous to the optical achromatic doublets.

It is a principal object of the invention to provide a new and improved waveguide lens.

It is another object of the invention to provide a waveguide lens having a substantially wider bandwidth than waveguide lenses of conventional design.

It is another object of the invention to provide a wideband waveguide lens that does not require zoning and that is more efficient than zoned waveguide lenses.

These together with other objects, features and advantages of the invention will become more readily apparent from the following detailed description when taken in conjunction with the illustrative embodiment in the accompanying drawings.

DESCRIPTION OF THE DRAWINGS

FIG. 4 is a schematic drawings showing the profile and relative dimensions of the compound lens of the invention;

FIG. 5 is a graph showing the normalized phase error of the compound waveguide lens of the invention;

FIG. 6 is a graph showing the bandwidth of the compound lens for center frequency design;

FIG. 7 is a graph illustrating phase error of single and two frequency designs for the waveguide lens of the invention;

DETAILED DESCRIPTION OF THE PREFERRED EMBODIMENT

Waveguide lenses are generally zoned to increase their bandwidths. The diameters of the zones are chosen to satisfy specific requirements; of particular interest are the two cases where the diameters are chosen to either minimize the thickness of the lens or to minimize the phase error over a frequency band. The minimum-phase-error zoned lens has more zones than the minimum-thickness zoned lens but it exhibits a much smaller phase error than the latter one. A different type of waveguide lens is the constant-thickness lens wherein the phase correction of off-axis rays is achieved by means of phase shifters inserted in the waveguide elements. A practical wideband phase shifter for this application is the half-wave plate which causes the phase of a circularly polarixed wave incident upon it to be shifted in accordance with the plate orientation. The differential phase shift is equal to twice the differential rotation of the plate and therefore is independent of frequency, provided the half-wave plate is broadband. Because the phase shift is constant with frequency the constant-thickness, half-wave-plate lens is narrowband.

The wideband waveguide lens of the invention is essentially a compound lens obtained by combining the geometric configuration of a conventional zoned waveguide lens with the phase shifting means of a constant-thickness, variable-phase-shift lens. The compound type waveguide lens comprehended by the invention is analogous to the optical achromatic doublet. It does not require zoning and avoids the shadowing effects that reduce efficiency in conventional zoned lenses.

Figure 1:
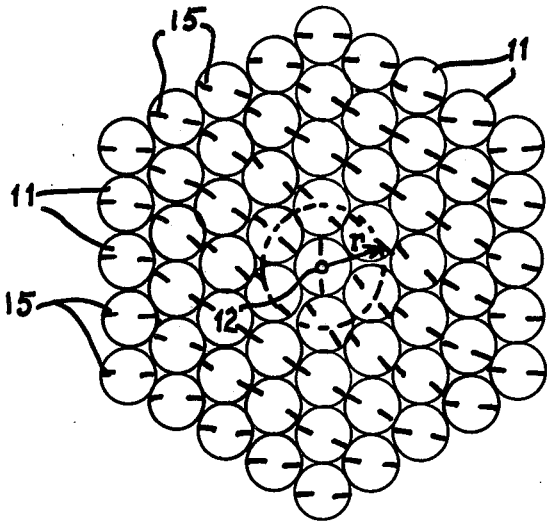
FIG. 1 is a schematic illustration showing, in elevation, the waveguide lens of the invention in elevation.
Figure 2:
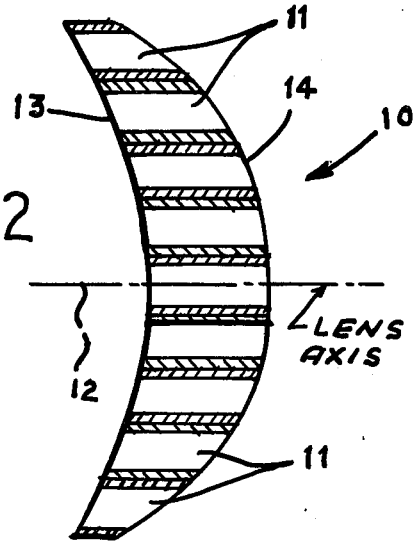
FIG. 2 is a sectional view showing the profile of the center row of waveguide elements of the lens of FIG. 1.

One presently preferred embodiment of the waveguide lens of the invention is shown schematically by FIG. 1. FIG. 2 shows a profile of the center row of waveguide elements of FIG. 1 and FIG. 3 is a detail of one typical waveguide element.

Figure 3A:
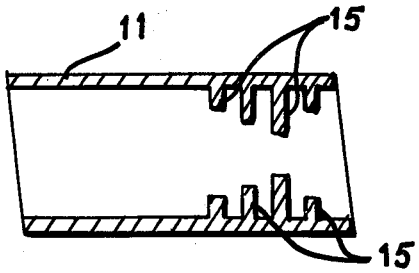
FIG. 3*a* and 3*b* are enlarged detail drawings of a typical waveguide element of FIG. 1.
Figure 3B:
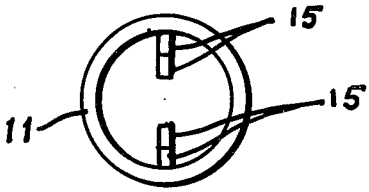

Referring now to FIGS. 1 and 2, the lens shown thereby is an assemblage or array of short waveguide elements 11 in a side by side honeycomb type arrangement. The number of waveguide elements is determined by the diameter of the lens and by the spacing between waveguides elements. The length of each waveguide element is determined by its radial distance r from the lens axis 12. The inside surface 13 of the lens may vary in shape but is generally a spherical cap with its center at the lens focus. The outside lens surface 14 is convex making the general shape of the lens 10 concave-convex. In each waveguide element 11 there is an identical phase shifting device 15 called a half-wave plate which can take any of several configurations. One such configuration is shown in FIGS. 3*a* and 3*b*. In this embodiment the phase shifting device comprises radial pins of appropriate lengths and spacings. The function of the half-wave plate is to cause the component of the wave parallel to the half-wave plate (parallel to the pins in the illustration) to be phase shifted 180 degrees with respect to the component of the wave perpendicular to the half-wave plate. The orientation of the half-wave plates (or pins) in each waveguide element 11 is determined by its radial distance r to the lens axis 12. The lens described operates with circularly polarized waves. With simple modifications it can be made to operate with linearly polarized waves. For example, circular to linear polarization devices can be inserted into each waveguide element.

Design of a wideband waveguide lens incorporating the principles of the invention must, of course, be predicated on design equations that provide the appropriate waveguide element length and phase shift values for any given set of parameters. The design equations, the phase error function and the bandwidth for the waveguide lens of the invention are hereinafter derived and a particular case considered which shows the phase error of the compound lens to be an order of magnitude smaller than that of the minimum-phase-error zoned lens.

The following derivations are made with reference to the compound lens 17 of FIG. 4. Referring thereto, consider the waveguide lens of FIG. 4 where each waveguide element 18 consists of a section of length L followed by a section of length T; the latter contains a phase shifter with phase shift $\phi$ independent of frequency. T is the same for all elements but L is a function of the element displacement r. Letting the length of the center element be $L_o$ and the differential phase caused by the phase shifter in this element be zero (i.e., $\phi=0$) and considering the case where the radius of the inner spherical surface of the lens is equal to the focal length, the equiphase condition is satisfied when $$2\pi nL/\lambda+\phi+2\pi t/\lambda=2\pi nL_o/\lambda \quad (1)$$

where $n=\{1-(\lambda/\lambda_c)^2\}^{\frac{1}{2}}$ and $\lambda_c$ is the waveguide cutoff wavelength. Referring to FIG. 4 it is seen that $t=L_o-L+s$ and therefore (1) can be expressed as $$(1-n)(L-L_o)-\phi\lambda/2\pi-s=0 \quad (2)$$

Since two parameters need to be determined, Eq. (2) may be satisfied at two frequencies or it may be satisfied at a single frequency and a second equation obtained by making (2) stationary with respect to frequency. These two cases are considered separately.

1. Single-Frequency Design

With $\lambda_o$ the design free-space wavelength and $n_o$ the corresponding index of refraction, (2) becomes $$(1-n_o)(L-L_o)-\phi\lambda_o/2\pi-s=0 \quad (3)$$

Making (3) invariant with respect to the free-space wavelength $\lambda_o$ leads to $$(L-L_o)\frac{dn_o}{d\lambda_o}+\phi\phi/2\pi=0 \quad (4)$$

Since $$n_o=\{1-(\lambda_o/\lambda_c)^2\}^{\frac{1}{2}} \quad (5)$$

$$\frac{dn_o}{d\lambda_o}=(n_o^2-1)/n_o\lambda_o \quad (6)$$

Substituting (6) in (4) and solving, there results $$L=L_o-n_os/(1-n_o) \quad (7)$$

and $$\phi=-2\pi s(1+n_o)/\lambda_o\pm 2m\pi \quad (8)$$

where m is an integer. For a lens of diameter D and with inner spherical surface of radius equal to the focal length F, the variable s is related to the radial distance r of a waveguide element by $$s=F-\{F^2-r^2\}^{\frac{1}{2}} \quad (9)$$

and $$s_{MAX}=F-\{F^2-D^2/4\}^{\frac{1}{2}} \quad (10)$$

The thickness of the lens at the center is obtained from (7) by making L=0 for $s=s_{MAX}$ *yielding*

$$L_o=n_os_{MAX}/(1-n_o) \quad (11)$$

The outer surface of the lens is convex as illustrated in FIG. 4. At the design frequency the lens is free of phase error and remains so for small deviations from this frequency. For larger deviations the phase error, i.e., the phase difference between a general ray and the center ray is $$\phi_e=2\pi nL/\lambda+\phi+2\pi t/\lambda-2\pi nL_o/\lambda=-2\pi/\lambda(L-L_o)(1-n)+2\pi s/\lambda+\phi \quad (12)$$

where $\lambda$ and n are, respectively, the free-space wavelength and the index of refraction at the operating frequency. Substituting L and $\phi$ from (7) and (8) into (12) the phase error of a center-frequency-designed compound lens becomes:

$$\phi_e=\frac{2\pi s}{\lambda_o}\left[\left(\frac{\lambda_o}{\lambda}\right)\left(\frac{1-n_on}{1-n_o}\right)-n_o-1\right] \quad (13)$$

The normalized phase error $\phi_e/(2\pi s/\lambda_o)$ is plotted in FIG. 5 as a function of $f/f_o$, for a practical value of the design index of refraction ($n_o=0.6$). Calculations indicate that the phase error decreases monotonically as $n_o$ increases and that $\Delta\phi_e/\phi_e\approx-\Delta n_o/n_o$. The bandwidth defined as the band over which the phase error does not exceed $\pi/4$ (corresponding to wavefront deviations of $\pm\lambda/16$) is given in FIG. 6 as a function $D/\lambda_o$. The bandwidth of the minimum-thickness zoned waveguide lens also shown in FIG. 6 is an order of magnitude smaller than that of the compound lens.

2. Two-Frequency Design

For the lens to be free of phase error at two frequencies Eq. (2) must be satisfied at each of these two frequencies, or $$(1-n_1)(L-L_o)-\phi\lambda_1/2\pi-s=0 \quad (14)$$

and $$(1-n_2)(L-L_o)-\phi\lambda_2/2\pi-s=0 \quad (15)$$

where $\lambda_1$, $\lambda_2$ are the free-space wavelengths and $n_1$, $n_2$ are the indices of refraction corresponding to the design frequencies. Solving $$L = L_o + \frac{s(\lambda_1-\lambda_2)}{(1-n_2)\lambda_1-(1-n_1)\lambda_2} \quad (16)$$

and $$\phi = \frac{2\pi(n_2-n_1)s}{(1-n_2)\lambda_1-(1-n_1)\lambda_2} \pm 2m\pi \quad (17)$$

At a different free-space wavelength, $\lambda$, the phase error obtained by substituting (16) and (17) in (12) is $$\phi_e = \frac{2\pi s}{\lambda}\left[\frac{\lambda_2(n_1-n)-\lambda_1(n_2-n)-\lambda(n_1-n_2)}{(1-n_2)\lambda_1-(1-n_1)\lambda_2}\right] \quad (18)$$

The phase error for a given wareguide element reaches a maximum at a free-space wavelength obtained by making $d\phi_e/d\lambda=0$ yielding $$n=(\lambda_2-\lambda_1)/(n_1\lambda_2-n_2\lambda_1) \quad (19)$$

to which corresponds $$\lambda=\lambda_1\{(n^2-1)/(n^2_1-1)\}^{1/2} \quad (20)$$

Figure 8:
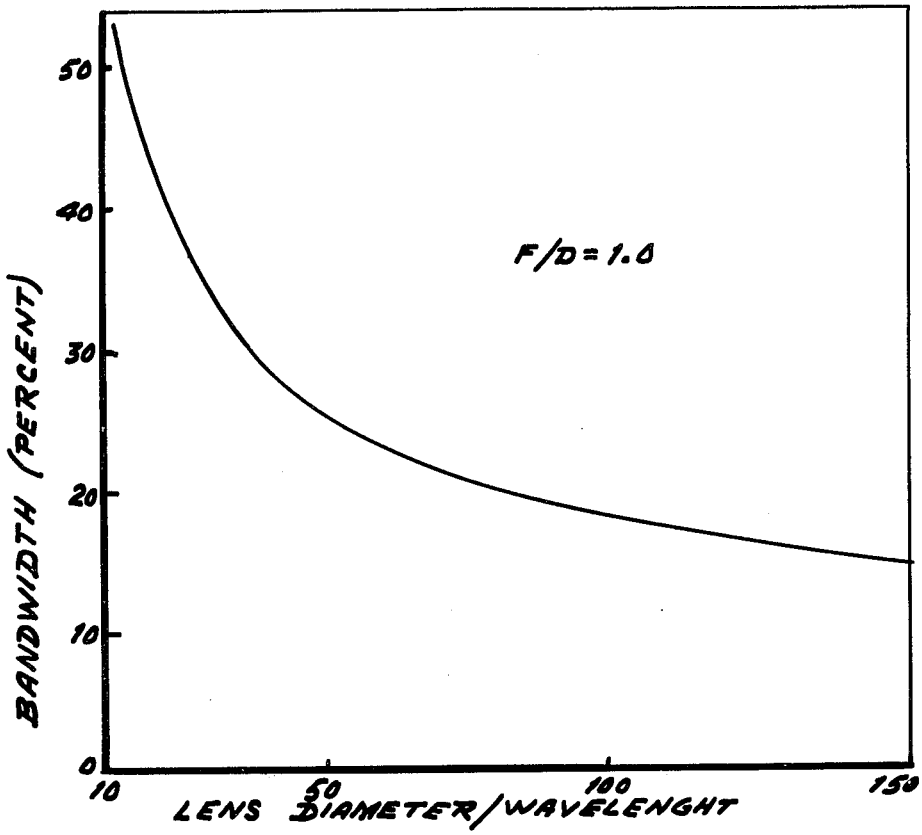
FIG. 8 is a graph illustrating the bandwidth of a compound lens for two frequency design.

The phase error at the edge of a compound lens with D=46 inches, F/D=1 and $n_o$=0.62 is plotted in FIG. 7 as a function of frequency. The top curve applies to a single-frequency design at $f_o$=8.15 GHz and the bottom curve applies to a two-frequency design with $f_1$=8.0 GHz and $f_2$=8.3 GHz. The bottom curve is very nearly identical to the top curve but displaced by an amount equal to the phase error of the single-frequency design at $f_1$ and $f_2$. Thus the optimum design frequencies for the two-frequency case may be determined from the phase error curve of the single-frequency design. The bandwidth of the two-frequency design is plotted in FIG. 8 as a function of $D/\lambda_o$ for F/D=1. The bandwidth is seen to vary from about 40 to 20 percent for lenses with diameters varying from 20 to 100 wavelengths. The bandwidth of the two-frequency design is about 40% greater than that of the single-frequency design.

Figure 9:
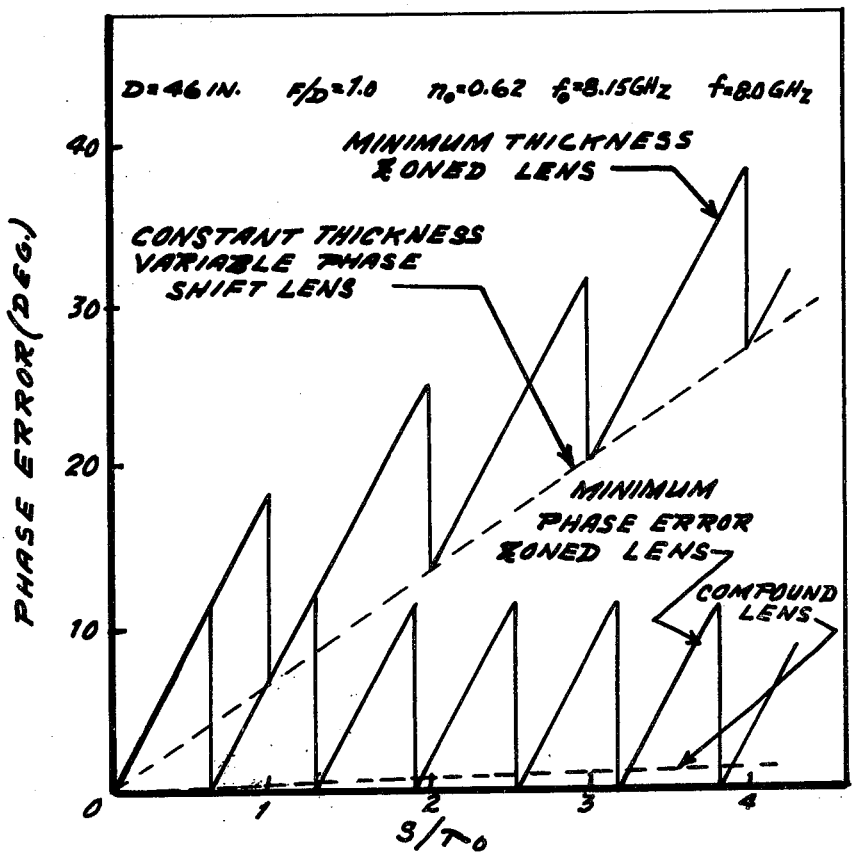
FIG. 9 is a graph illustrating the phase error of various waveguide lenses.

For comparison the phase error of the two types of zoned lenses and of the constant-thickness, variable-phase-shift lens are plotted as a function of $s/\lambda_o$ in FIG. 9, together with that of the single-frequency-design-compound lens. The design frequency and index of refraction for all lenses are identical, namely 8.15 GHz and 0.62, respectively, and the phase error is calculated for a frequency of 8.0 GHz. The phase error of the compound lens is observed to be an order of magnitude smaller than that of the minimum-phase-error zoned lens.

While the invention has been described in terms of one presently preferred embodiment, it is understood that the word which have been used are words of description rather than words of limitation and that changes within the preview of the appended claims may be made without departure from the scope and spirit of the invention in its broader aspects.

What is claimed is:

1. A waveguide lens comprising a two dimensional array of waveguide elements arranged in proximate juxtaposition, a centrally positioned waveguide element of said array having a length $L_o$ and having its longitudinal axis coincident with the lens electromagnetic wave transmission axis, each other waveguide element having a length L that is a function of its radial distance from the lens electromagnetic wave transmission axis, and a frequency insensitive phase shift means in each waveguide element, the length L of each waveguide element being derived from the equation $L=L_o-n_os/(1-n_o)$ and the phase shift $\phi$ for each phase shift means being derived from the equation $\phi=-2\pi s(1+n_o)/\lambda_o\pm 2m\pi$, m being an integer, $\lambda_o$ the design free space wavelength $n_o$ the corresponding index of refraction, and $s=F-\{F^2-r^2\}^{1/2}$ where F is the lens focal length and r the radial distance of a waveguide element from the lens axis.

2. A waveguide lens comprising a two dimensional array of waveguide elements arranged in proximate juxtaposition, a centrally positioned waveguide element of said array having a length $L_o$ and having its longitudinal axis coincident with the lens electromagnetic wave transmission axis, each other waveguide element having a length L that is a function of its radial distance from the lens electromagnetic wave transmission axis, and a frequency insensitive phase shift means in each waveguide element, the length L of each waveguide element being derived from the equation $$L = L_o + \frac{s(\lambda_1-\lambda_2)}{(1-n_2)\lambda_1-(1-n_1)\lambda_2}$$

and the phase shift $\phi$ for each phase shift means being derived from the equation $$\phi = \frac{2\pi(n_2-n_1)s}{(1-n_2)\lambda_1-(1-n_1)\lambda_2} \neq 2\pi,$$

m being an integer, $\lambda_1$, $\lambda_2$ the free space wavelengths of first and second design frequencies, $n_1$, $n_2$ the indices of refraction corresponding to the design frequencies, and $s=F-\{F^2-r^2\}^{1/2}$ where F is the lens focal length and r the radial distance of a waveguide element from the lens axis.

* * * * *